US008288637B2

(12) United States Patent
Kingsley

(10) Patent No.: US 8,288,637 B2
(45) Date of Patent: Oct. 16, 2012

(54) TORSION OSCILLATED SPRING CORDED CONTRABASS GUITAR

(76) Inventor: Merari Z. Kingsley, Allentown, PA (US)

( * ) Notice: Subject to any disclaimer, the term of this patent is extended or adjusted under 35 U.S.C. 154(b) by 191 days.

(21) Appl. No.: 12/924,255

(22) Filed: Sep. 23, 2010

(65) Prior Publication Data

US 2011/0067549 A1 Mar. 24, 2011

(51) Int. Cl.
*G10D 3/14* (2006.01)

(52) U.S. Cl. ..... 84/312 P; 84/313

(58) Field of Classification Search ..... 84/312 R, 84/312 P, 313

See application file for complete search history.

(56) References Cited

U.S. PATENT DOCUMENTS 3,407,697 A * 10/1968 Jackson ..... 84/312 P
4,080,864 A * 3/1978 Jackson ..... 84/312 P
7,645,927 B1 * 1/2010 Jackson ..... 84/312 R

* cited by examiner

*Primary Examiner* — Jeffrey Donels

(74) *Attorney, Agent, or Firm* — Sanford J. Piltch

(57) ABSTRACT

The present invention is directed to a contrabass guitar which oscillates the pitch of the guitar by the use of torsion. The strings of the guitar are adjusted by use of a torsion control means connected to a foot pedal to allow a player to easily adjust the pitch of the guitar while playing. The contrabass guitar includes a floating bridge and a stationary torsion block with a plurality of helically twisted tuning control rods attached. The floating bridge contains a plurality of pitch tuning cylinders connected on one end to respective strings and on the other to the tuning rods. The floating bridge moves along the body of the guitar in response to the torsion control means causing the tuning cylinders to slide over the tuning control rods and to rotate according to the twists of the rods creating greater or lesser torsion uniformly in the strings. Depressing and releasing the foot pedal allows a player to adjust the string torsion force by using only the foot pedal without having to manually adjust string tension interrupting the playing of the guitar.

7 Claims, 3 Drawing Sheets

TORSION OSCILLATED SPRING CORDED CONTRABASS GUITAR

BACKGROUND OF THE INVENTION

The present invention resides in the field of musical instruments, particularly, a bass guitar in which the tones register lower than in an ordinary base guitar. Therefore, this invention should be considered as a contrabass guitar.

The classical contrabass guitar is tuned EADGBE, like the classical guitar but one octave lower. In this sense, it may actually be considered as an acoustic bass guitar, for it shares the same low-end range. Although called a contrabass guitar, the fact that it is tuned one octave lower than a normal guitar means that it is in actuality an acoustic bass guitar rather than a contrabass instrument. One ground on which it differs from an acoustic bass guitar is the thickness of the strings, which thickness is less than an acoustic bass guitar. Thus, it lacks the "thick" tone, which is a unique feature of bass guitars. Contrabass guitars from the 1970s are often tuned "B-E-A-D-G-C" (B=B0—the lowest B on the piano), and usually have a solid wooden body.

In a stringed instrument, such as a guitar or bass guitar, the strings are typically supported at the neck of the instrument and at the bridge, being free to vibrate along their length between these two points of support. Ideally, the supporting points are rigid so that they do not move, flex, or vibrate with the strings. Such movement would absorb energy from the string, dampening the sound. The ability of the string to vibrate without dampening is often referred to as a tone sustaining characteristic. Where the instrument utilizes a sound board, the bridge also has the function of transferring the vibrations of the string to the sound board with the minimum of distortion and loss. Both of these requirements are best satisfied by a substantially rigid bridge.

Countering these requirements is a desire for the position of the strings to be adjustable. Musicians have individual preferences for the height of the string above the finger board. The closer the string to the fingerboard, the less effort required in fingering the string. However, if the string is too close, it may buzz against the finger board. Individual height adjustment of the strings is a common approach to meeting the musician's needs.

Traditionally, the string support at the neck of the instrument is fixed, so the above adjustments must be accomplished at the bridge. A wide variety of bridges have been developed and are in use which provide both height and length adjustment for the individual strings. However, this adjustability comes at a cost. The bridge can no longer be a single, rigid piece. Multiple elements must be provided and interconnected to provide the two independent adjustments. Any element which is free to move, linearly or axially, or flex, and any connection which allows free play or introduces friction, results in a loss of energy and a dampening of the sound. Where sound transfer to the sound board is desired, these losses directly impact the quality and quantity of the sound transferred.

The contrabass is spring corded rather than corded with ordinary flat wound steel bass strings. The current bass guitars have strings under tensile stress whereby the pitch of the bass varies with the more tension applied to the strings. The relationship is directly proportional in that the higher the tension applied, the higher the pitch. The physical relationship of tension to pitch does not govern the musical function of the bass guitar. The tension on a tuned bass guitar does not change; the sole change is the length to pitch relationship. When a player's fingers depress the strings on the bass fret board, various notes on the octave scale create bass guitar music. Therefore, the directly physical relationship of length to pitch determines the musical function of the bass guitar.

The present invention for tuning a contrabass guitar employs a torsion to pitch relationship rather than the traditional tension to pitch or length to pitch relationship in the existing bass guitars. As the torsion is increased, the pitch of the guitar is also increased. Further, the present invention allows a player to adjust the torsion by the use of a foot pedal that connects to a floating bridge to adjust the pitch of the strings without having to manually adjust the torsion while playing the guitar and allows a player to raise or lower the pitch "hands-free" while playing the instrument.

According to one aspect of the invention, the floating bridge moves up and down the body of the contrabass guitar following the foot pedal depression. This movement causes tuning cylinders to move in a rotational motion sliding forward and back over helically twisted flat tuning control rods fixedly attached to the torsion block at the bottom of the guitar face. This movement creates greater and lesser torsion in the strings resulting in changes of pitch. The freedom of movement up and down the body by the floating bridge is made possible by a pair of wheels mounted to an axle supporting the floating bridge in a perpendicular orientation to the guitar body below.

The floating bridge movement is controlled by the depression and release of a foot pedal connected to the bridge by a cable. The cable is connected to a bar on the side of the bridge facing the cable connection in which the bar extends across the bridge to provide a uniformly equal force across the bridge to retain the bridge in a parallel relationship to the strings for equal torsion/pitch adjustment across all of the strings. The functional relationship of the floating bridge, the tuning control rods and cylinders, the string torsion, and the cable the reactionary force combine to provide the torsion means to vary the pitch of the strings of the musical instrument, in this case a contrabass guitar.

The advantages of such an apparatus are a stringed musical instrument which employs torsion to pitch relationship, rather than the traditional tension to pitch or length to pitch relationship in the existing bass guitars, allows a player to create a higher pitch than possible in the existing bass guitars. Moreover, the present contrabass guitar allows a player to adjust the tension by the use of a foot pedal that connects to the floating bridge moving the bridge and applying greater or lesser torsion force to the strings without having to manually adjust the string tension while playing the guitar. The above and other features and advantages of the present invention will become more clear from the detailed description of a specific illustrative embodiment thereof, presented below in conjunction with the accompanying drawings.

SUMMARY OF THE INVENTION

The present invention is directed to a contrabass guitar which changes the pitch of the guitar "strings" by the use of torsion and provides the adjustment, change of torsion, to the strings by use of a torsion inducing means connected to a foot pedal. Thus, by way of a foot pedal cable, a player can easily adjust the pitch of the guitar, i.e., change the torsion and pitch of the strings, while playing with improved rigidity and sound transfer over earlier devices.

According to the invention there is provided a contrabass guitar having a floating bridge. The "floating bridge" has a plurality of tuning cylinders with slots on their proximal end to accommodate a corresponding number of tuning control rods and open on their distal end to receive the spring-like wound strings. The floating bridge is connected to the cable pitch control of the foot pedal such that as the pedal is depressed the bridge moves toward the cable connection at the bottom of the guitar. As the floating bridge moves toward and away from the cable connection, the tuning cylinders uniformly slide over the tuning control rods rotating along the turns of the tuning rods which, in turn, rotate the attached strings changing the pitch of those strings.

The distal end of each tuning cylinder is course grooved to allow the springs of the 16-gauge steel strings to anchor in the grooves of the cylinders and to be retained in the grooves by cylindrical clamps and an additional C-type clamp for each such string. The tuning cylinders are positioned between paired coaxial apertures corresponding to each string tuning cylinder pair for rotational movement within the floating bridge housing. This allows the tuning cylinders to rotate freely around the tuning control rods as the floating bridge is moved toward and away from the string torsion block. The torsion block remains stationary and is fixedly fastened to the body of the contrabass guitar to support and anchor the plurality of tuning control rods having one respective end of each rod securely fastened to it with the other end free to cooperate with the concentric slot of each respective tuning cylinder.

BRIEF DESCRIPTION OF THE DRAWINGS

For the purpose of illustrating the invention, there is shown in the drawings forms which are presently preferred; it being understood, however, that the invention is not limited to the precise arrangements and instrumentalities shown.

DETAILED DESCRIPTION OF THE PREFERRED EMBODIMENTS

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
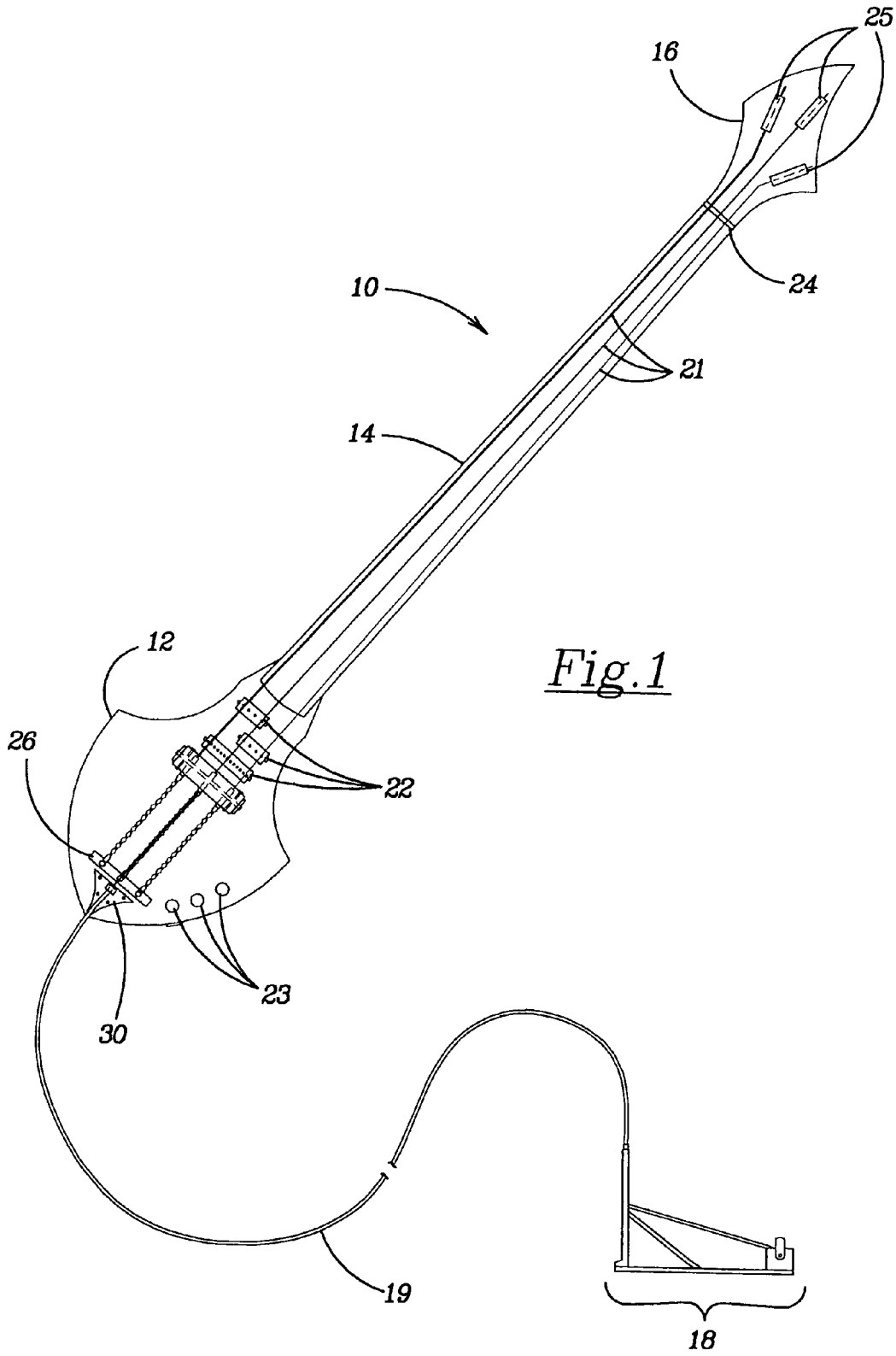
FIG. 1 is a perspective view of the various elements of the stringed instrument of the present invention.

Referring now to the drawings in detail, wherein like numerals refer to like parts or elements, there is shown in FIG. 1 the present invention which may be described as a contrabass guitar 10 which oscillates the pitch of the guitar by the use of torsion. The contrabass guitar 10 has a body 12, a neck 14, a head 16 and a foot pedal 18. The head 16 contains at least three tuning pegs 25 which manually tune the strings 21 of the contrabass guitar 10. Below the head 16 is a guide 24 that holds the strings in proper position on the guitar 10. The body 12 contains groupings of customary controls and audio reproduction elements including a plurality of sound pickups 22 and volume and tone controls 23. Also located on the body 12 are a bridge saddle 26, a mounting plate for cable control 30 secured by pins 32 to the body 12. The bridge saddle or torsion block 26 connects a floating bridge 28 to the foot pedal 18 by means of cable 19. The foot pedal 18 and cable 19 enable hands free adjustment of the strings 21 by use of a torsion means contained within the floating bridge 28 to allow a player to easily adjust the pitch of the guitar 10 while playing.

The tuning pegs 25 located at the head 16 of the guitar 10, tune each of the strings 21 to a respective bass pitch appropriate for each of the strings 21. The tuning pegs 25 will increase or decrease the tension on each of the strings 21 before torsion is applied. The cable 19 will provide torsion force to each of the strings 21 to increase their respective pitches equally, as more fully described below, or allow the pitch to return to the tuned pitch originally set for the instrument.

Figure 2:
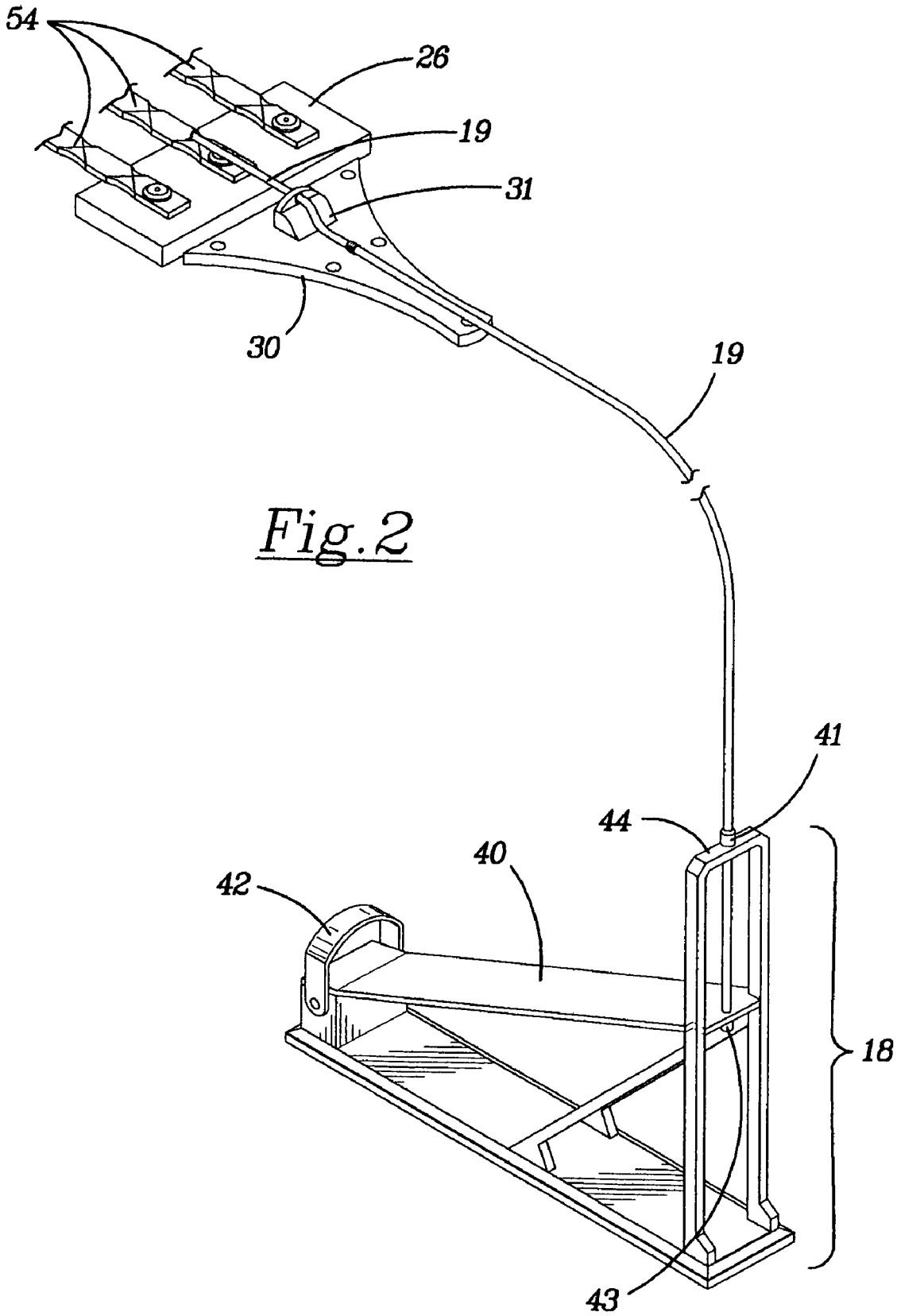
FIG. 2 is a perspective view of the pedal connection to the stringed instrument of the present invention.

Referring now to FIG. 2, there is shown a perspective view of the foot pedal assembly 18 which has a pedal 40 for accommodating the foot of the guitar player and a stirrup 42 at the base of the pedal to maintain the foot in proper position to manipulate the pedal 40. The cable 19 is connected to the pedal 40 at one end and to the floating bridge 28 at the other end. The cable 19 is housed in a flexible sturdy sheath which may be similar in construction to the housing of the emergency brake cable on a vehicle. A spring mechanism of any suitable type returns the pedal 40 to its rest position, as shown in FIG. 2, when the player is not depressing the pedal 40. The cable sheath is clamped in position at the top bar 44 of the foot pedal assembly 18 and the cable 19 is connected to the pedal 40 at its distal end, directly below the clamp 41 by a second clamp 43. At its other end that cable is connected to a tuning control bar 70 that is part of the floating bridge 28. It is the cable 19, by means of the foot pedal 18, that is used to alter the pitch of the strings 21 as the floating bridge 28 is pulled closer to the torsion block 26 or allowed to return to its rest position upon release of the cable 19.

As part of FIG. 2, there is shown an enlarged torsion block 26 and cable mounting plate 30. Cable height adjusting block 31 is positioned to maintain the cable 19 from kinking and to alter the height of the cable 19 to pass above the tuning control rods 54 so as not to interfere with the sounding of the instrument 10. The tuning control rods 54 are secured to the torsion block 26 by any suitable fastening means to maintain their respective positions parallel to the string 21 and perpendicular to the floating bridge 28. The tuning rods 54 are intended to be depicted as flat rods helically twisted along each of their respective longitudinal axes to create a rotational tuning track for the tuning cylinders 38 to be described more fully below. Thus, once the player steps downward on the foot pedal 40 the tuning control bar 70 on the floating bridge 28 is pulled toward the torsion block 26 causing the strings to twist along their central axes in accordance with the helical twists of the tuning control rods 54 causing a torsion force to tighten the strings 21 changing the pitch of the guitar 10.

Figure 3:
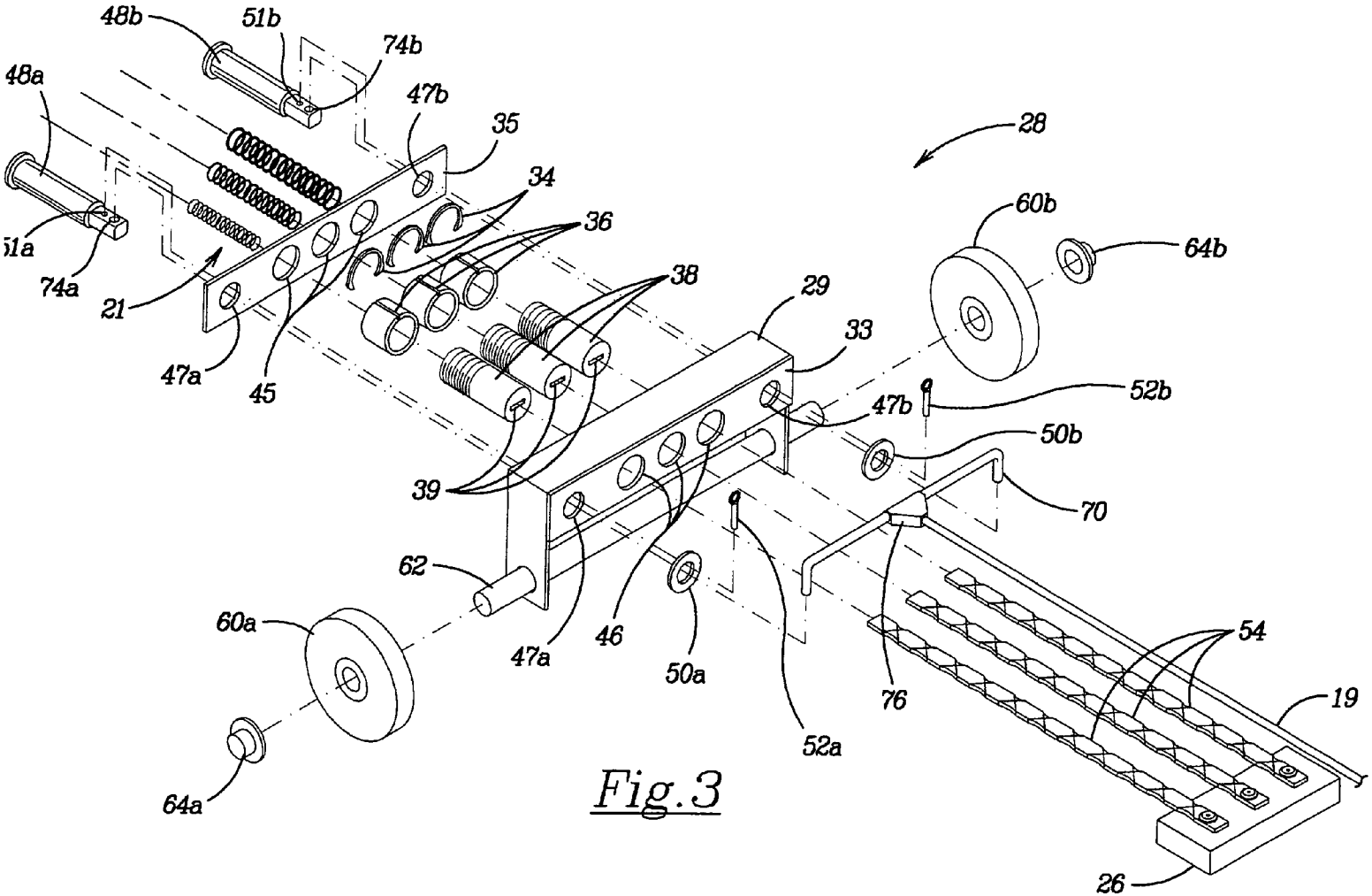
FIG. 3 is an exploded sectional view of the floating sound bridge and string torsion elements of the stringed instrument of the present invention.

FIG. 3 is an exploded view of the components comprising the floating bridge 28. Some of the dimensions or sizes of individual components have been exaggerated for ease of understanding. The floating bridge 28 contains a plurality of tuning cylinders 38 with concentric slots 39 on its proximal end, its central interior being hollow, and its distal end open. The free ends of the tuning control rods 54 fit into the concentric slots 39 on the proximal end of the tuning cylinders 38. The cylinders 38 slide over each of the corresponding plurality of tuning control rods 54 and are free to rotate about each respective tuning control rod 54. The number of tuning control rods 54 corresponds to the number of tuning cylinders 38 which, in turn, correspond to the number of strings 21 of the instrument.

The tuning cylinders 38 are housed within the floating bridge housing 29 that has a front and a back plate 31, 33, respectively. At the distal end of the tuning cylinders 38 are a series of grooves for intertwining the ends of the strings 21 that are secured within the grooves by cylindrical clamping members 36 which fit around the diameter of the tuning cylinders 38 holding the strings 21 in place. The steel wire strings 21 are anchored to the grooved portion of the tuning cylinders 38 by an additional C-type clamping means 34 that fits over both the individual string 21 and the tuning cylinder 38. The tuning cylinders 38, with the captured strings 21 held in position by the clamps 34, 36, fit through the holes in the front plate 33 of the housing 29 and permit the tuning control rods 54 to fit into the corresponding concentric slots 39 that will permit the tuning cylinders 38 to rotate freely within the holes 46 following the helical twists of the flat tuning control rods 54 as the floating bridge 28 moves in accord with the tension placed on the cable 19.

The strings 21 anchor to the floating bridge 28 by fitting around and into the grooves on the outer circumference of the string-end of the tuning cylinder 38 with the clamps 34, 36 fitting over and onto both the strings 21 and the cylinders 38. The tuning cylinders 38 are situated within the housing of the floating bridge 28 such that they extend outward slightly from the holes 46 in front plate 33 and are maintained within the housing 29 by the rear plate 35. Only the strings 21 exit from the rear of the floating bridge 28 through the rear plate 35. The string clamps 34, 36 prevent the tuning cylinders 38 from exiting the floating bridge housing 29 through the string holes 45 in the rear plate 35.

The floating bridge housing 29 is held together with clevis pins 48*a*, 48*b* having a ring flange at their respective distal ends to hold the plate 35 against the remainder of the housing 29 as the pins 48*a*, 48*b* extend through a pair or coaxially aligned mounting holes 47*a*, 47*b* in both the front and rear plates 33, 35. The pins 48*a*, 48*b* are held in position by washers 50*a*, 50*b* placed around the pins 48*a*, 48*b* at the front plate 33 and cotter pins 52*a*, 52*b* positioned within locking apertures 51*a*, 51*b*.

The floating bridge 28 is mounted on bearings or wheels 60*a*, 60*b* located at both ends of axle 62 which extends the length of the floating bridge 28 directly below the housing 29. The wheels 42 are approximately ¾ inches in diameter to maintain the coaxial alignment of the strings 21, the tuning cylinders 38, and the tuning control rods 56, as well as the respective height above the sound board for each of these elements, to permit the floating bridge 28 free and unimpeded movement back and forth over the body 12. The wheels 60*a*, 60*b* are retained on the ends of axle 62 by end caps 64*a*, 64*b* that merely snap over the end of the axle 62. With this construction, the floating bridge 28 maintains coaxial alignment of the strings 21 and tuning control rods 54 permitting the tuning cylinders 38 to rotate freely around the tuning control rods 54 without changing the spacing between these elements and the instrument body 12. In accordance with the proper alignment of elements, the floating bridge 28 is maintained in perpendicular alignment to the strings 21 and the tuning control rods 54 so that the torsion tuning of the tuning cylinders 38 can be accomplished uniformly for all stings 21 in a simultaneous fashion. Also assisting in maintaining the alignment and parallelity of the floating bridge 28 is the tuning control bar 70.

The tuning control bar 70 is mounted onto the floating bridge 28 across the front plate 33 above the apertures 46. The tuning control bar 70 has a set of legs at both ends that extend downward and are friction mounted into mounting holes 74*a*, 74*b* at the most proximal extension of the clevis pins 48*a*, 48*b*. In this way, when mounted, the tuning control bar is in parallel to the front plate 33 and the housing 29 of the floating bridge 28 and either draws the floating bridge 28 toward, or pushes it away from the torsion block 26 while maintaining the precise orientation of the floating bridge 28 to all of the other elements noted above. The tuning bar 70 is connected, at its midpoint, to the cable 19 by a connector 76 that spreads the force exerted by the cable 19 laterally along the control rod 70.

The torsion block 56 is fastened by screws to the body 12 of the contrabass guitar 10 to provide the static contact point for the string-tuning cylinder-tuning rod combination at the base of the instrument 10. The torsion block 56 consists of a solid block of suitable sound dampening material having a length sufficient to accommodate the plurality and lateral spacing of the tuning control rods 54 required for the instrument. Each tuning control rod 54 is fixedly attached to the torsion block 26 by a suitable non-loosening fastening means such that the tuning control rods 54 are maintained in perpendicular alignment to the length of the block 26 extending across the base of the instrument, and therefore, in parallel to the extend strings 21 extending along the neck 14 of the instrument 10. The height of the torsion block 26 is selected depending upon the desired height of the strings 21 above the sound board of the instrument 10 and the required coaxial alignment of the tuning cylinders 38 and the cooperative interaction of the tuning control rods 54 within the concentric slots 39 that create the torsion controlled pitch changes of the strings 21.

The floating bridge 28 is capable of movement toward and away from the torsion block 26 along the sound board of the body 12 of the contrabass guitar 10. This movement is controlled by the cable 19 connected to the tuning control bar 70 mounted to the floating bridge 28. The back and forth movement of the floating bridge 28 allows the tuning cylinders 38 to move in a circular or spiral motion sliding over the free ends of the respective tuning control rods 54, fixed at their other ends to the torsion block 56, with the concentric slots 39 following the helical twists of the respective flat tuning control rods 54. This back and forth movement creates either greater or lesser torsion or twisting force on the strings 21 resulting in a pitch change that is effected uniformly for all of the strings of the instrument.

The tuning control bar 70 reacts to the cable 19 connected at the middle of the bar 70. The cable 19 is preferred to be a flexible braid of twelve (12) gauge steel wire with one end attached to tuning control bar 70 mounted to the floating bridge 28 on the guitar body 12 and the second end of the cable 19 anchored to the foot pedal assembly 18 as described above. The floating bridge 28 will follow the motion of the cable 19*b* and the pedal 40 and, as the pedal 40 is depressed, the cable 19 causes the floating bridge 28 to move toward the torsion block 26. In accordance with this motion, the tuning cylinders 38 begin to turn as the concentric slots 39 follow the helical twists of the torsion control rods 54 causing the strings 21 to have an increased torsion, and therefore, increasing the pitch of the strings 21 uniformly across the entire instrument 10. The same action will be true such that as the foot pedal 40 is released, or its depression is lessened, the cable pushes that floating bridge 28 away from the torsion block 26 causing the tuning cylinders 38 to rotate in the opposite direction decreasing the torsion force on the strings 21 resulting in a decrease of the pitch associated with the strings 21 uniformly across the entire instrument 10. In this way, the pitch of the strings 21 is controlled from the foot pedal assembly 18 in such a manner that the player is no longer required to manually place any impediment against string vibration across the strings to achieve a pitch change of the instrument.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

The invention claimed is:

1. A spring corded musical instrument capable of adjusting the pitch of the strings by the use of a string torsion control means allowing a player easy adjustment of the pitch of the guitar while playing comprising:

a musical instrument having a neck and a body with a plurality of strings having one end of each of said plurality of strings attached at the distal end of the neck;

a string torsion block mounted at the base of the body having a plurality of torsion control rods corresponding to the number of strings, said torsion control rods being fixedly mounted to the torsion block at their respective proximal ends and their distal ends extending toward the neck in parallel alignment one to the other;

a floating bridge interposed between the plurality of strings and the corresponding plurality of torsion control rods including a corresponding plurality of hollow tuning cylinders fixedly connected at one end to each of the respective strings and having concentric slots in the other end for accepting the free ends of the torsion control rods;

a foot pedal for controlling the movement of a foot pedal cable connecting to a tuning control bar attached to said floating bridge;

said floating bridge capable of motion responsive to the depression and release of the foot pedal effected by the foot pedal cable drawing the floating bridge toward or pushing the floating bridge away from the torsion block causing the tuning cylinders within the floating bridge to follow the helical twists of the torsion control rods such that the tuning cylinders rotate resulting in the increase and decrease of torsion force on the strings attached to the respective tuning cylinders uniformly changing the pitch of the strings.

2. The musical instrument of claim 1, wherein said plurality of strings, said plurality of tuning cylinders of said floating bridge, and said plurality of torsion control rods are maintained in coaxial alignment with each other and in parallel alignment with each set of said plurality of strings, said plurality of tuning cylinders of said floating bridge, and said plurality of torsion control rods.

3. The musical instrument of claim 1, wherein said plurality of strings are attached along the exterior circumference of said plurality of tuning cylinders by one or more string clamps to allow said tuning cylinders free circular or spiral motion as said tuning cylinders slide over said tuning control rods creating greater or lesser torsion in the strings of the musical instrument.

4. The musical instrument of claim 1, wherein said plurality of tuning cylinders are externally grooved on the end closest to said strings to allow said strings to be retained in said grooves of said tuning cylinders.

5. The musical instrument of claim 1, wherein said floating bridge has a translational motion means located below the plurality of tuning cylinders allowing said floating bridge stabile, free movement along the body of the musical instrument in response to the movement of the foot pedal through the foot pedal cable and tuning control bar.

6. The musical instrument of claim 5, wherein the translational motion means comprises at least one pair of wheels mounted to a fixed axle dimensioned to maintain the coaxial alignment of said tuning cylinders with the plurality of strings and the plurality of tuning control rods and provide substantially friction free motion over and along the body of the musical instrument.

7. The musical instrument of claim 1, wherein said foot pedal cable being anchored to the mid-point of said tuning control bar by a connecting means that laterally spreads the force exerted on the tuning control bar and the floating bridge in order to maintain the perpendicularity of the floating bridge to the plurality of strings and the tuning control rods and the parallelity of the floating bridge to the string torsion block.

* * * * *